US009538836B2

(12) United States Patent
Mintel et al.

(10) Patent No.: US 9,538,836 B2
(45) **Date of Patent: *Jan. 10, 2017**

(54) ORAL CARE IMPLEMENT

(75) Inventors: Thomas Mintel, Rahway, NJ (US); Douglas Hohlbein, Hopewell, NJ (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 679 days.

This patent is subject to a terminal disclaimer.

(21) Appl. No.: 13/979,631

(22) PCT Filed: Oct. 17, 2011

(86) PCT No.: PCT/US2011/056557

§ 371 (c)(1),
(2), (4) Date: Jul. 12, 2013

(87) PCT Pub. No.: WO2012/096700

PCT Pub. Date: Jul. 19, 2012

(65) Prior Publication Data

US 2013/0291326 A1 Nov. 7, 2013

Related U.S. Application Data

(60) Provisional application No. 61/432,109, filed on Jan. 12, 2011.

(51) Int. Cl.

| | |
|---|---|
| ***A46B 9/04*** | (2006.01) |
| ***A46D 1/00*** | (2006.01) |
| *A46B 3/06* | (2006.01) |

(52) U.S. Cl.

CPC . *A46B 9/04* (2013.01); *A46D 1/00* (2013.01); *A46D 1/0238* (2013.01);

(Continued)

(58) Field of Classification Search

CPC ..... A46B 9/04; A46B 2200/1066

See application file for complete search history.

(56) References Cited

U.S. PATENT DOCUMENTS 3,613,143 A * 10/1971 Muhler ..... A46D 1/00 15/167.1

6,090,488 A 7/2000 Kweon (Continued)

FOREIGN PATENT DOCUMENTS

| | | |
|---|---|---|
| CN | 2513434 | 10/2002 |
| DE | 27 28 672 | 1/1979 |

(Continued)

OTHER PUBLICATIONS

International Search Report and Written Opinion of the International Searching Authority issued in International Application No. PCT/US2011/056557 mailed Jan. 26, 2012.

(Continued)

*Primary Examiner* — Randall Chin

(57) ABSTRACT

A toothbrush comprising a tapered bristle having a cross-sectional profile with a major axis and a minor axis. In one embodiment, the invention can be an oral care implement comprising: a head; a handle; and at least one tapered bristle extending from a face of the head, the tapered bristle having a longitudinal axis and a transverse cross-sectional profile having a major axis and a minor axis, the major axis being longer than the minor axis.

20 Claims, 9 Drawing Sheets

(52) U.S. Cl.
CPC ..... *A46D 1/0276* (2013.01); *A46B 3/06* (2013.01); *A46B 2200/1066* (2013.01)

(56) References Cited

U.S. PATENT DOCUMENTS

| | | | | |
|---|---|---|---|---|
| 8,522,389 | B2 * | 9/2013 | Kwon | A46D 1/0276 15/167.1 |
| 2012/0284945 | A1 * | 11/2012 | Lotscher | A46D 3/045 15/167.1 |

FOREIGN PATENT DOCUMENTS

| | | |
|---|---|---|
| DE | 199 42 147 | 3/2001 |
| EP | 0 663 162 | 7/1995 |
| JP | 11 290133 | 10/1999 |
| JP | 2000-033010 | 2/2000 |
| JP | 2000 354520 | 12/2000 |
| JP | 2004 202021 | 7/2004 |
| WO | WO89/06528 | 7/1989 |

OTHER PUBLICATIONS

Written Opinion of the International Preliminary Examining Authority issued in International Application No. PCT/US2011/056557 mailed Jan. 24, 2013.

* cited by examiner

ORAL CARE IMPLEMENT

CROSS-REFERENCE TO RELATED APPLICATIONS

The present application is a U.S. national stage application under 35 U.S.C. §371 of PCT Application No. PCT/US2011/056557, filed Oct. 17, 2011, which in turn claims the benefit of U.S. Provisional Application No. 61/432,109, filed on Jan. 12, 2011, the entireties of which are incorporated herein by reference.

FIELD OF THE INVENTION

The present invention relates generally to oral care implements, and more specifically to oral care implements comprising tapered bristles having non-circular transverse cross-sectional profiles.

BACKGROUND OF THE INVENTION

A toothbrush is used to clean the teeth by removing plaque and debris from the tooth surfaces. Conventional toothbrushes having a flat bristle trim are limited in their ability to conform to the curvature of the teeth, to penetrate into the interproximal areas between the teeth, to sweep away the plaque and debris, and to clean along the gum line. Additionally, such toothbrushes have a limited ability to retain dentifrice for cleaning the teeth. During the brushing process, the dentifrice typically slips through the tufts of bristles and away from the contact between the bristles and the teeth. As a result, the dentifrice is often spread around the mouth, rather than being concentrated on the contact of the bristles with the teeth. Therefore, the efficiency of the cleaning process is reduced.

While substantial efforts have been made to modify the cleaning elements of toothbrushes to improve the efficiency of the oral cleaning process, the industry continues to pursue arrangements of cleaning elements that will improve upon the existing technology. In typical oral care implements, bristles having circular transverse cross-sectional profiles are bundled together in a bristle tuft and mounted within tuft holes having circular transverse cross-sectional profiles. However, such a configuration results in gaps being present between adjacent bristles in the tuft and between the bristles of the tuft and the walls of the tuft holes, thereby resulting in a looser packing of the tuft hole and a less than optimal packing factor. These gaps can also reduce the effectiveness of the oral care implement and can cause the oral care implement to effectuate an uncomfortable feeling during brushing.

Additionally, the use of tapered bristles on oral care implements has also recently become more popular due to the ability of the tapered bristles to penetrate into hard to reach crevices and their softer feel. However, known oral care implements that include tapered bristles suffer from the drawback that the tapered bristles tend to flex too easily during use and have short lifetimes due to wear.

Therefore, a need exists for an oral care implement having an improved arrangement of tapered bristles.

BRIEF SUMMARY OF THE INVENTION

Embodiments of the present invention provide for an oral care implement having a handle, a head, and at least one tapered bristle extending from a face of the head.

In one embodiment, the invention can be an oral care implement comprising: a head; a handle; and at least one tapered bristle extending from a face of the head, the tapered bristle having a longitudinal axis and a transverse cross-sectional profile having a major axis and a minor axis, the major axis being longer than the minor axis.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The features of the exemplified embodiments will be described with reference to the following drawings in which like elements are labeled similarly. The present invention will become more fully understood from the detailed description and the accompanying drawings, wherein.

DETAILED DESCRIPTION OF THE INVENTION

Figure 1A:
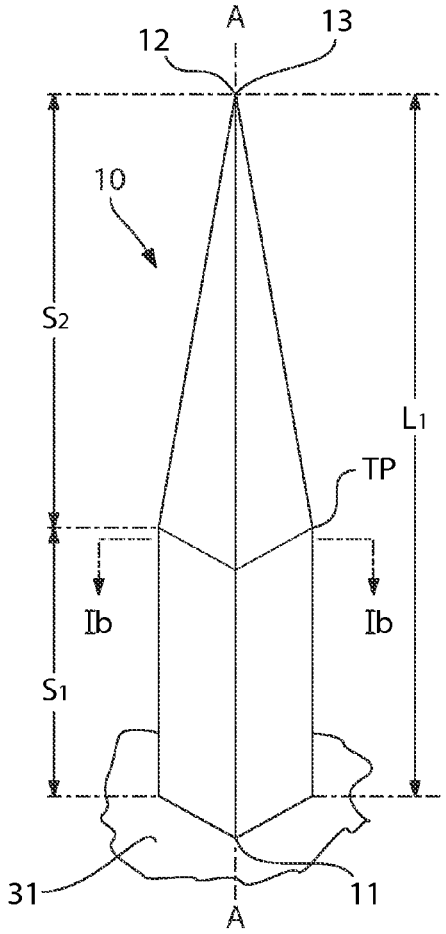
FIG. 1*a* is a front perspective view of a tapered bristle in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," "mounted" and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Figure 1B:
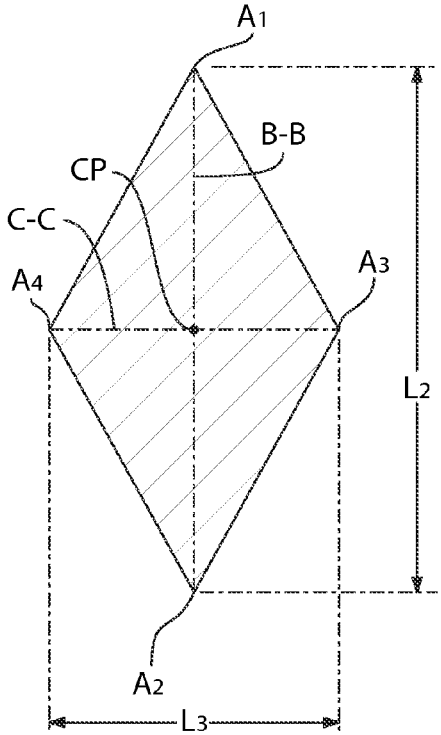
FIG. 1*b* is a transverse cross-section of the tapered bristle of FIG. 1*a* taken along view Ib-Ib.

Referring to FIGS. 1*a* and 1*b*, a tapered bristle 10 according to an embodiment of the present invention is illustrated extending from a face 31 of a head of an oral care implement, such as a toothbrush. The tapered bristle 10 extends from the face 31 of the head of the oral care implement from a fixed end 11 of the tapered bristle 10 to a free end 12 of the tapered bristle 10 along a longitudinal axis A-A of the tapered bristle 10. The tapered bristle 10 has a length $L_1$, measured from the face 31 of the head to the free end 12 of the tapered bristle 10 along the longitudinal axis A-A of the tapered bristle 10. In certain embodiments, the length $L_1$ of the tapered bristle 10 may be in a range of 10 mm to 20 mm. Of course, the invention is not so limited and the length $L_1$ of the tapered bristle 10 can be selected as desired for a particular toothbrush or section of a toothbrush.

In the exemplified embodiment, the tapered bristle 10 comprises a non-tapered longitudinal section $S_1$ and a tapered longitudinal section $S_2$. The non-tapered longitudinal section $S_1$ of the tapered bristle 10 extends from the face 31 of the head to a transition point TP of the tapered bristle 10, and has a transverse cross-sectional profile that is substantially constant in both size and shape. The tapered longitudinal section $S_2$ of the tapered bristle 10 extends from the transition point TP to the free end 12 of the tapered bristle 10, and has a transverse cross-sectional profile that decreases in size from the transition point TP to the free end 12, thereby forming a point/tip 13 at the free end 12. In the exemplified embodiment, the transverse cross-sectional profile of the tapered longitudinal section $S_2$ corresponds in shape to the transverse cross-sectional profile of the non-tapered longitudinal section $S_1$ along its entire length. However, in other embodiments, the shape of the transverse cross-sectional profile of the tapered longitudinal section $S_2$ may change and/or be different than the shape to the transverse cross-sectional profile of the non-tapered longitudinal section $S_1$.

In one preferred embodiment, the tapered longitudinal section $S_2$ has a length (measured along the longitudinal axis A-A of the tapered bristle 10) that is at least one third of the length $L_1$ of the tapered bristle 10. In an even more preferred embodiment, the tapered longitudinal section $S_2$ has a length that is at least one half of the length $L_1$ of the tapered bristle 10. Of course, in alternate embodiments of the invention, the tapered longitudinal section $S_2$ my have a length that takes up a greater or lesser percentage of the length $L_1$ of the tapered bristle 10.

The tapered bristle 10 can be formed of a wide variety of materials suitable for forming filaments for oral use, including without limitation, polybutylene terephthalate, polyethylene terephthalate, nylon or the like. The tapering of the tapered longitudinal section $S_2$ can be achieved by a variety of techniques known in the art. For example, the tapered bristle 10 may be tapered by applying a chemical, such as a sulfuric acid solution, to the second longitudinal section $S_2$ of the tapered bristle 10 via an immersion or spray technique. During such a process, the chemical erodes away portions of the bristle 10 to form the taper. Alternatively, the bristle 10 may be tapered by mechanical means, including shaving the bristle ends with the blade of a knife or with a rounding machine.

In the exemplified embodiment, the transverse cross-sectional profile of the tapered bristle 10 comprises a major axis B-B and a minor axis C-C. The major axis B-B is longer than the minor axis C-C. More specifically, the major axis B-B has a length $L_2$ while the minor axis C-C of the bristle 10 has a length $L_3$, wherein the length $L_2$ of the major axis B-B is larger than the length $L_3$ of the minor axis C-C. In one embodiment, the ratio of the length $L_2$ of the major axis B-B to the length $L_3$ of the minor axis C-C is preferably greater than or equal to 1.2:1. In other embodiments, the ratio of the length $L_2$ of the major axis B-B to the length $L_3$ of the minor axis C-C is between 1.5:1 and 3:1.

In the exemplified embodiment, the major axis B-B of the transverse cross-sectional profile of the tapered bristle 10 is substantially perpendicular to the minor axis C-C of the transverse cross-sectional profile of the tapered bristle 10. However, the invention may not be so limited in certain other embodiments. The major axis B-B and the minor axis C-C intersect at a center point CP of the transverse cross-sectional profile of the tapered bristle 10. In the exemplified embodiment, the center point CP is coincident with the longitudinal axis A-A of the tapered bristle 10.

In the exemplified polygonal embodiment of the transverse cross-sectional profile of the tapered bristle 10, the major axis B-B extends between a first pair of opposing apexes $A_1$, $A_2$ of the transverse cross-sectional profile of the tapered bristle 10 while the minor axis C-C extends between a second pair of opposing apexes $A_3$, $A_4$ of the transverse cross-sectional profile of the tapered bristle 10. Of course, the invention is not so limited and when the transverse cross-sectional profile of the tapered bristle 10 takes on other polygonal shapes or an elongated oval shape, the major and minor axes A-A, B-B may terminate at a midpoint of the linear sides or curves of those shapes.

In the exemplified embodiment, the tapered bristle 10 has a transverse cross-sectional profile that is in the shape of a diamond. Of course, the invention is not so limited and the transverse-cross-sectional profile of the tapered bristle 10 may take on a wide variety of shapes that include a major axis that is greater in length than a minor axis. For example, without limitation, the tapered bristle 10 may have a transverse cross-sectional profile in the shape of an elongated rectangle, an elongated oval, or other polygonal shape.

Figure 2A:
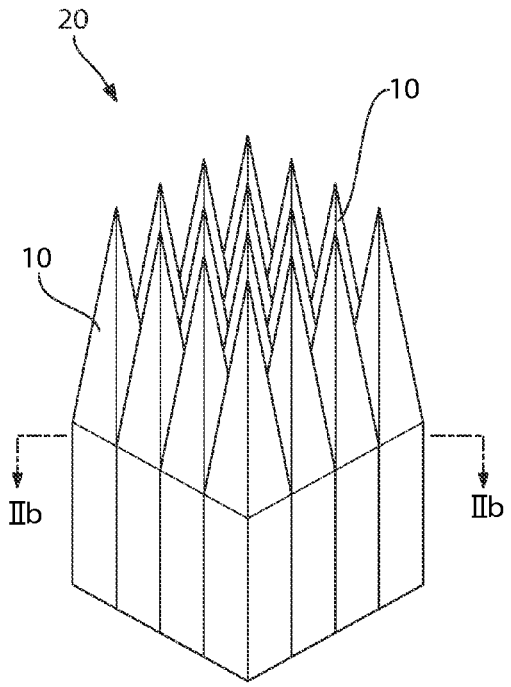
FIG. 2*a* is a perspective view of a bristle tuft formed by a plurality of the tapered bristles of FIG. 1*a* in accordance with an embodiment of the present invention.
Figure 2B:
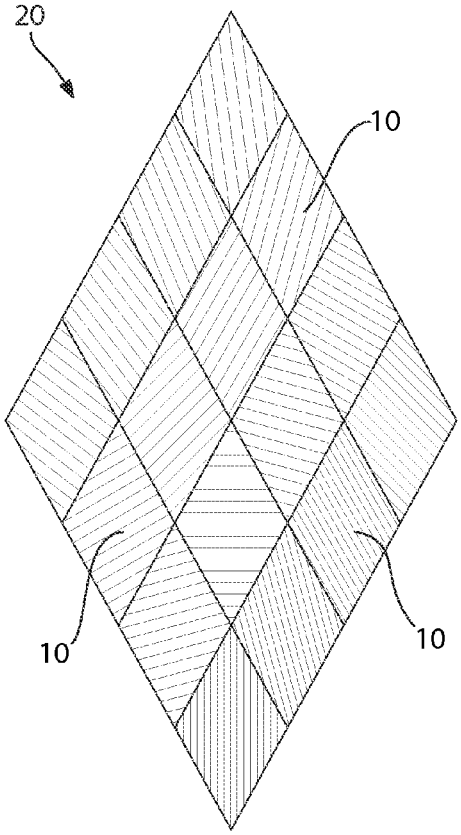
FIG. 2*b* is a transverse cross-section of the bristle tuft of FIG. 2*a* taken along view IIb-IIb of FIG. 2*a*.

Referring now to FIGS. 2*a* and 2*b*, a plurality of the tapered bristles 10 are illustrated bundled together to form a bristle tuft 20. Due to the diamond shape of the bristles 10, each of the bristles 10 has four straight edges. Thus, when the bristles 10 are bundled together to form the bristle tuft 20, adjacent bristles 10 can be positioned so that their edges are aligned and abutted directly against each other. Such an arrangement prevents the formation of gaps between adjacent bristles 10 in the tuft 20 and maximizes the number of individual tapered bristles 10 that can be bundled together to form the bristle tuft 20 while staying within a desired area. Of course, the invention is not so limited and in certain embodiments when the transverse cross-sectional shape of the tapered bristle 10 is an elongated oval, there may be small gaps between adjacent bristles 10.

By tightly packing the tapered bristles 10 to form the bristle tuft 20 with little or no gaps in between the tapered bristles 10, comfort of the bristle tuft 20 is enhanced. Furthermore, keeping the bristles 10 in close relation results in capillary action, which enables dentifrice or other agents present on the bristles 10 to flow towards the tips of the bristles 10. This promotes contact of the dentifrice with the user's oral cavity. Furthermore, having the tufts 20 formed with little or no gaps enhances the light reflection on the tufts 20 so that consumers viewing the tufts 20 see them as shinier and more attractive.

Finally, by packing the tapered bristles 10 as shown to form the bristle tuft 20 with little or no gaps therebetween, an increased packing factor is achieved when the bristle tuft 20 is mounted within a tuft hole. Packing factor is defined as the sum total of the transverse cross-sectional areas of the tapered bristles 10 in the tuft hole divided by the transverse cross-sectional area of the tuft hole. In embodiments where anchors, such as staples, are used to mount the bristle tuft 20 within the tuft hole, the area of the anchoring means is excluded from the transverse cross-sectional area of the tuft hole. Thus, as discussed in greater detail below, if the tuft hole is designed to have a polygonal transverse cross-sectional profile, the packing factor is further increased because gaps between the polygonal transverse cross-sectional profiles of the tapered bristles 10 of the bristle tuft 20 and the walls of the tuft are further reduced and/or eliminated due to the matable geometry. In certain of these embodiments, the geometries can be selected so that the packing factor of the tuft hole is greater than 90%, or even greater than 95%. In further of these embodiment, if tuft hole is designed to have a polygonal transverse cross-sectional profile that corresponds (i.e., is the same) in size and shape to the polygonal transverse cross-sectional profile of the bristle tuft 20, the packing factor of the tuft hole can be approximately 100%.

Referring still to FIG. 2*b*, the bristle tuft 20 has a non-circular transverse cross-sectional profile. More specifically, in the exemplified embodiment, the shape of the transverse cross-sectional profile of the bristle tuft 20 corresponds to (i.e., is the same as) the shape of the transverse cross-sectional shape of the individual tapered bristles 10 that make up the tuft 20. Although the bristles 10 and tufts 20 are illustrated having a diamond transverse cross-sectional shape, the tapered bristles 10 and the resulting bristle tufts 20 could have other corresponding transverse cross-sectional shapes as desired. For example, both the individual tapered bristles 10 and the resulting bristle tufts 20 can have elongated rectangular transverse cross-sectional shapes. Alternatively, in certain other embodiments, the individual tapered bristles 10 can have a transverse cross-sectional profile that has a different shape than that of the transverse cross-sectional profile of the bristle tuft 20.

Figure 3:
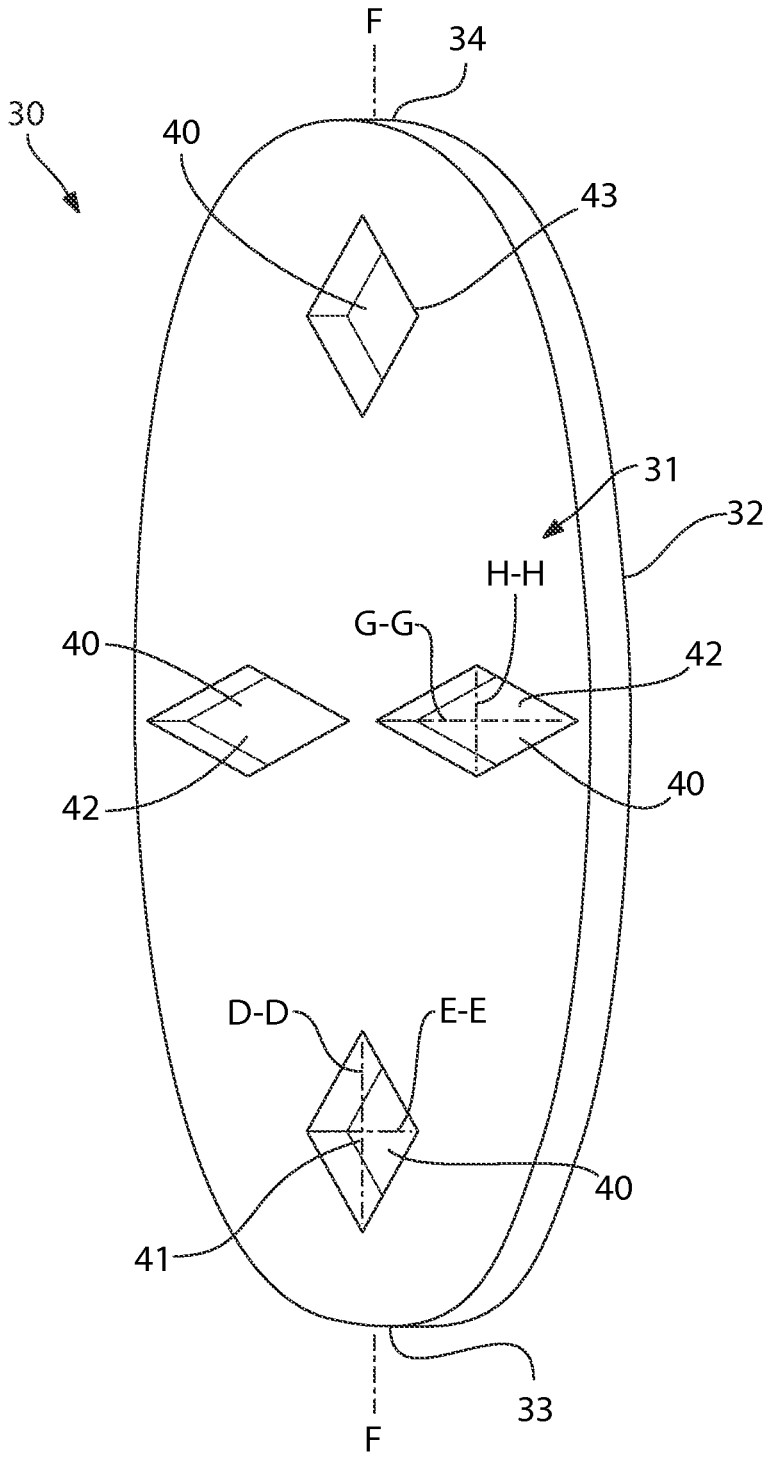
FIG. 3 is a perspective view of a tuft plate having a plurality of tuft holes formed therein in accordance with an embodiment of the present invention.

Referring to FIG. 3, a tuft plate 30 that can be used to mount the bristle tufts 20 (or individual tapered bristles 10) to a head of an oral care implement is illustrated. The tuft plate 30 has a longitudinal axis F-F (which also serves as, or is coextensive with, the longitudinal axis of the head of the oral care implement when the tuft plate 30 is mounted to the body of the head). The tuft plate 30 is created as a separate component from the body of the head of the toothbrush in order to enable the bristle tufts 20 (or the tapered bristles 10) to be secured to the tuft plate 30 via anchor free tufting (AFT) technology, as is known in the art. Once the bristle tufts 20 (or the tapered bristles 10) are mounted to the tuft plate 30, the tuft plate 30 is secured or mounted to the body of the head of the toothbrush to form the head of the toothbrush. Of course, in certain other embodiments, the bristle tufts 20 (or the tapered bristles 10) can be mounted directly to a toothbrush by inserting the bristle tufts 20 (or the tapered bristles 10) into preformed tuft holes and using anchors, such as staples, to secure the bristle tufts 20 (or the tapered bristles 10) therein, as would be known to persons skilled in the art. Additionally, in-mold tufting can also be used. Thus, it is to be understood that the discussion below regarding the details of the tuft holes 40 and their relative orientation is equally applicable to embodiments of the invention where a tuft plate is not used and the tuft holes are preformed in the head and secured thereto using staples or IMT.

The tuft plate 30 is illustrated having four tuft holes 40. Of course, the invention is not so limited and more or less than four tuft holes 40 can be used as desired. Each of the tuft holes 40 is an aperture that extends through the plate 30 and forms a passageway from an upper face 31 of the plate 30 to a lower face 32 of the plate 30. In the exemplified embodiment, each of the tuft holes 40 has a polygonal transverse cross-sectional shape, which in the exemplified embodiment is in the shape of a diamond. Of course, other polygonal or elongated oval shapes can be utilized in certain other embodiments of the invention.

Similar to the tapered bristle 10, each of the tuft holes 40 has a major axis D-D and a minor axis E-E, wherein the major axis D-D is longer than the minor axis E-E. Of course, the invention is not so limited and in certain other embodiments, the tuft holes 40 may take on other polygonal or elongated-oval shapes that do not have major axis that is longer than the minor axis. Furthermore, in still other embodiments where the focus of the invention is on the shape of the tapered bristles 10 without regard to the tuft holes, the tuft holes 40 may be circular in shape.

In certain embodiments, the tuft holes 40 are oriented on the tuft plate 30 (or the head of the oral care implement directly) so that the major axis of at least one of the tufts holes 40 is non-parallel to the major axis of another one of the tufts holes 40. In the exemplified embodiment, the tuft holes 40 are oriented on the tuft plate 30 so that at least a first one 41 of the tuft holes 40 has its major axis D-D aligned substantially perpendicular to the major axis G-G of a second one 42 of the tuft holes 40. In alternate embodiments, the major axis D-D of the first one 41 of the tuft holes 40 can be arranged at other non-parallel angles. In certain embodiments of the invention, the oral care implement will have at least two tuft holes 40 wherein their major axes are oriented at an angle between 10° to 80° relative to one another. By arranging the tuft holes 40 so that their major axes are in non-parallel arrangement with respect to one another, the bristle tufts 20, when mounted therein, will provide different degrees of resistance to bending in different directions. For example, when the bristle tuft 20 is mounted in the first one 41 of the tuft holes 40, the bristle tuft 20 will provide a greater amount of resistance to bending in a direction along the major axis D-D in comparison to the amount of resistance to bending in a direction along the minor axis E-E (similar to the discussion below regarding the individual tapered bristle 10, relating to FIGS. 7*a-d*). Thus, a bristle tuft 20 mounted in the first one 41 of the tuft holes 40 will provide an increased resistance to bending, and thus a greater ability to penetrate into dental crevices, when subject to forces parallel to the longitudinal axis F-F of the tuft plate 30 (or longitudinal axis of the head). To the contrary, a bristle tuft 20 mounted in the second one 42 of the tuft holes 40 will provide an increased resistance to bending, and thus a greater ability to penetrate into dental crevices, when subject to forces transverse to the longitudinal axis F-F of the tuft plate 30 (or longitudinal axis of the head). Thus, an oral care implement designed as such includes bristle tufts 20 formed of tapered bristles 10 that provide greater ability to penetrate and clean due to their increased resistance to bending in multiple directions. As discussed below with respect to FIGS. 7*a-d* and 8*a-b*, this increased resistance to bending in multiple directions can also be achieved at the bristle level instead of or in addition to the bristle tuft level.

Furthermore, while in the exemplified the embodiment, the major axis D-D of the first one 41 of the tuft holes 40 is substantially parallel with the longitudinal axis F-F of the plate 30 and the major axis G-G of the second one 42 of the tuft holes 40 is substantially perpendicular to the longitudinal axis F-F of the plate 30, the invention is not so limited and many other angles of the major axes D-D, G-G relative to the longitudinal axis F-F of the plate 30 (and to each other) may be utilized.

The tuft hole 41 is a proximal-most tuft hole positioned at a proximal end 33 of the plate 30. Furthermore, there is a distal-most tuft hole 43 that is positioned at a distal end 34 of the plate 30. Both of the proximal-most and distal-most tuft holes 41, 43 are oriented so that their major axes D-D are substantially parallel to the longitudinal axis F-F. Furthermore, two second tuft holes 42 are provided near the lateral sides of tuft plate 30. The two tuft holes 42 have major axes G-G that are substantially perpendicular to the longitudinal axis F-F of the tuft plate 30. While a total of four tuft holes 40 are exemplified in a specific arrangement and orientation, the tuft holes 40 can be positioned on the plate 30 in a wide variety of numbers, arrangements and orientations to achieve the desired bristle pattern and cleaning effect.

In certain alternate embodiments, the major axes D-D of the tuft holes 41, 43 are non-parallel with the major axes G-G of the tuft holes 42, regardless of their orientation with respect to the longitudinal axis F-F of the plate 30 (or the longitudinal axis of the head). Therefore, in certain embodiments, configurations other than those illustrated are within the scope of the present invention, so long as the major axes D-D, G-G of at least two of the tuft holes 40 are non-parallel with respect to one another. In even further embodiments of the invention, the major axes of all of the tuft holes 40 may be parallel with respect to one another, or may not even have major axes at all.

Figure 4:
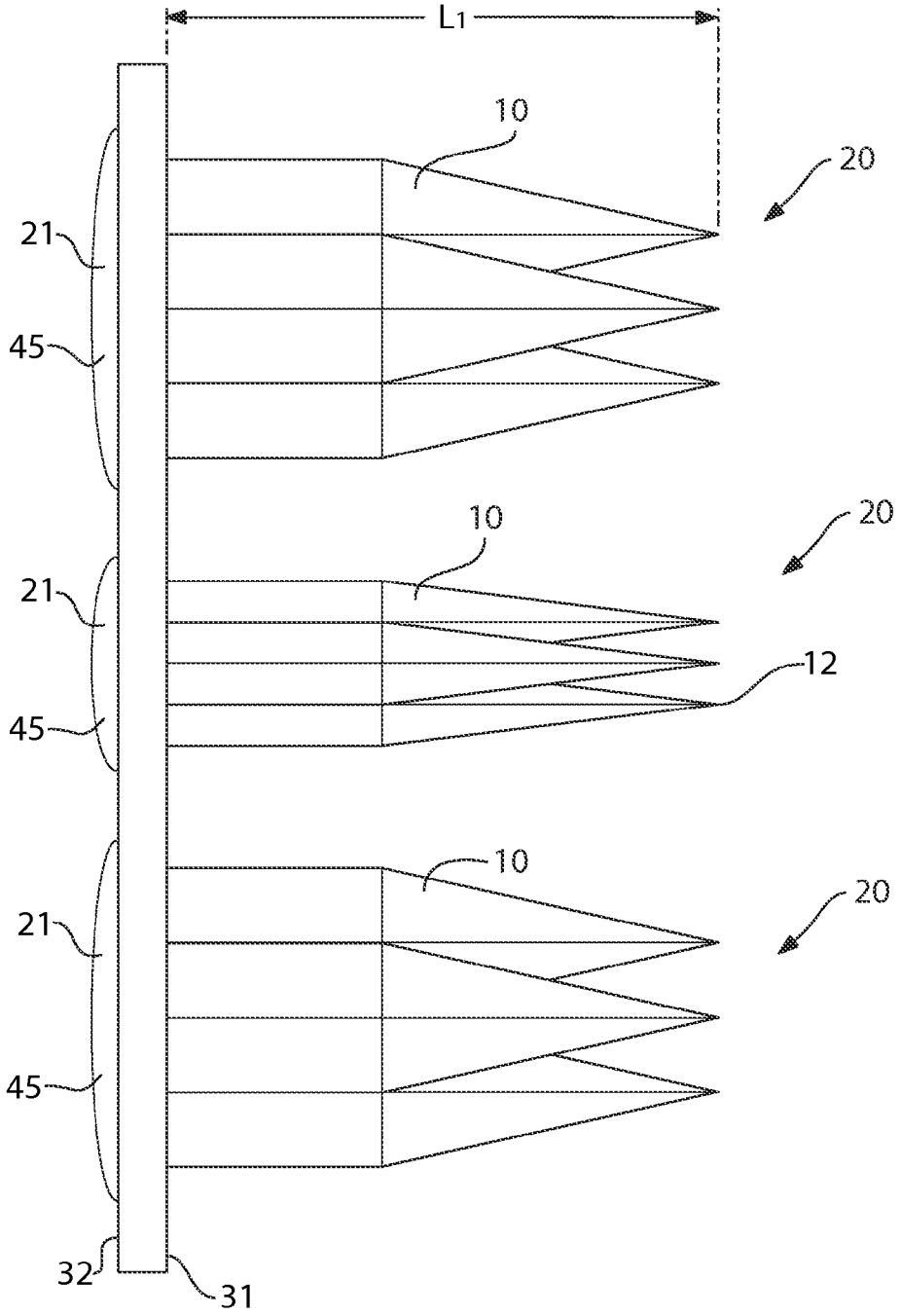
FIG. 4 is a side view of the tuft plate of FIG. 3 wherein a bristle tuft of FIG. 2*a* is mounted within each of the tuft holes in accordance with an embodiment of the present invention.

Referring to FIG. 4, one method of mounting of the tapered bristles 10 in the tuft holes 40 of the tuft plate 30 will be described. Initially, a bristle tuft 20 (see FIG. 2*a*) is inserted into each of the tuft holes 40 so that a proximal end 21 of the bristle tuft 20 extends through the tuft hole 40. As mentioned above, due to the transverse cross-sectional profile of the tufts holes 40 corresponding to (i.e., being the same as) the transverse cross-sectional profile of the bristle tuft 20 in both size and shape, a packing factor of approximately 100% is achieved.

When inserted into the tuft holes 40, the proximal ends 21 of the bristle tufts 20 protrude from the lower surface 32 of the tuft plate 30. The remainder of the length of the bristle tufts 20 extends from the upper face 31 of the tuft plate 30 a distance $L_1$. As will be described in more detail below, once the tuft plate 30 is mounted to the body of the head, the upper face 31 of the plate 30 becomes the face of the head. In alternate embodiments where a tuft plate 30 is not used, the bristle tufts may be inserted into the tuft holes 40 which are formed directly into the body of the toothbrush head and secured therein via anchors, IMT, r other known techniques The proximal ends 21 of the bristle tufts 20 are then melted through the application of heat, thereby creating a melted portion 45 as a result of the proximal ends of the individual tapered bristles 10 in the bristle tuft 20 melting and merging together. The melted portions 45 are adjacent to and protrude from the lower surface 32 of the tuft plate 30 and prevent the bristle tufts 20 from being pulled back out of the tufts holes 40 due to the size of their size.

Figure 5:
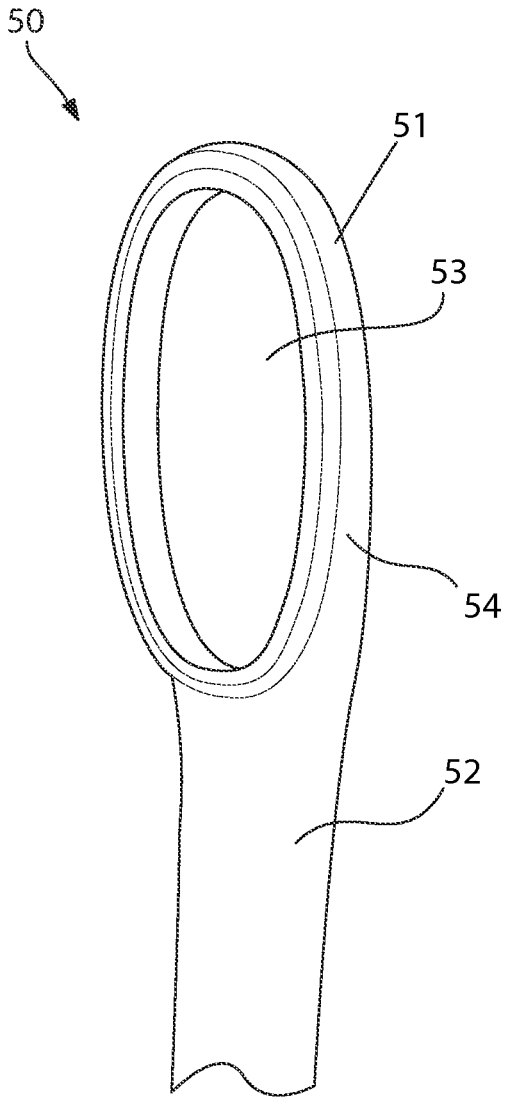
FIG. 5 is a perspective view of a body of a head of an oral care implement.
Figure 6:
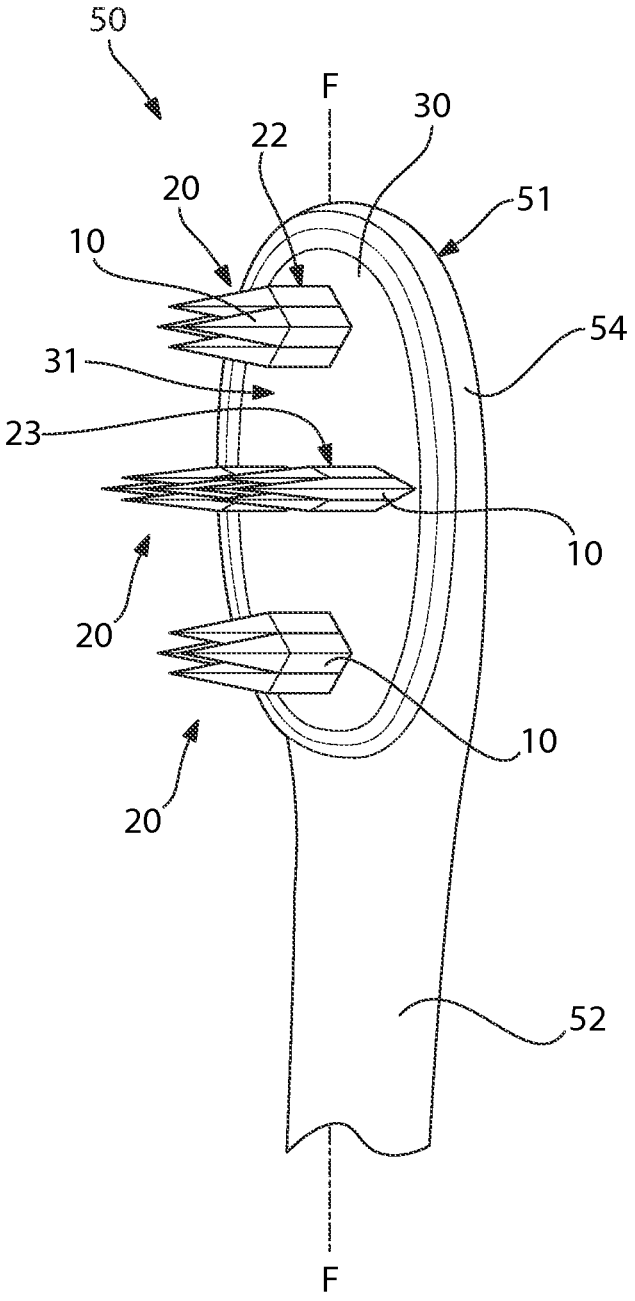
FIG. 6 is a perspective view of the body of the head of the oral care implement of FIG. 5 having the tuft plate of FIG. 4 mounted therein in accordance with an embodiment of the present invention.

Referring now to FIGS. 5-6 concurrently, after the bristle tufts 20 are secured to the tuft plate 30 as described above, the tuft plate 30 is mounted to the body 54 of the head 51 of the oral care implement, which is in the form of toothbrush 50. The toothbrush 50 comprises a head 51 and a handle 52 (only a portion of which is illustrated). When assembled, the head 51 comprises both the body 54 and the assembled tuft plate 30. The body 54 of the head 51 has a cavity 53 that is sized and shaped to fit the plate 30 therein. Thus, after the bristles 10 are secured to the plate 30, the plate 30 is mounted to the body 54 of the toothbrush head 51. Mounting of the assembled tuft plate 30 to the body 54 of the head 51 is achieved by positioning the assembled tuft plate 30 within the cavity 53 of the body 54 and then securing the assembled tuft plate 30 to the body 54 via any manner known in the art, such as by ultrasonic welding or the like. In other embodiments, the assembled tuft plate 30 may be secured to the body 54 of the head 51 by a snap-fit or interference fit arrangement or by any other means as would be known to persons skilled in the art. It should be understood that once the assembled tuft plate 30 is mounted to the body 54 of the head 51, the tuft plate 30 becomes a part of the head 51 so that the longitudinal axis F-F of the plate 30 is also the longitudinal axis of the head 51.

Referring solely now to FIG. 6, when the toothbrush 50 is fully assembled, the bristle tufts 20 (each of which includes a plurality of tapered bristles 10) extend from the face 31 of the head 51. In the exemplified embodiment, four bristle tufts 20 are included on the head 51, which comprise a first bristle tuft 22 and as second bristle tuft 23. The first bristle tuft 22 has a major axis that is non-parallel to the major axis of the second bristle tuft 23, and more specifically, is substantially perpendicular thereto.

Figure 8A:
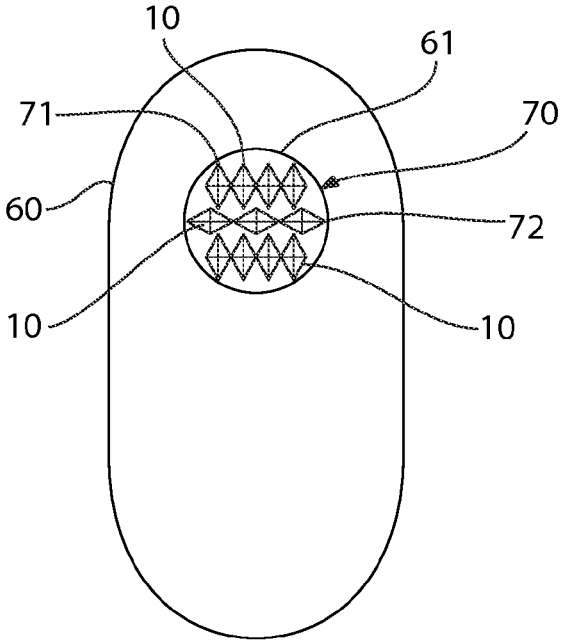
FIG. 8*a* is a front view of a head of an oral care implement having a plurality of the tapered bristles of FIG. 1*a* mounted thereto in a first arrangement in accordance with an embodiment of the present invention.
Figure 8B:
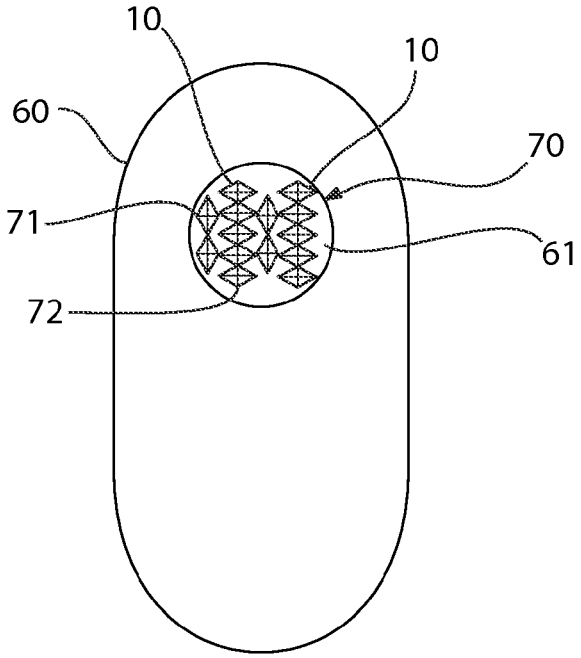
FIG. 8*b* is a front view of a head of an oral care implement having a plurality of the tapered bristles of FIG. 1*a* disposed therein in a second arrangement in accordance with an embodiment of the present invention.

As a result of their arrangement within the bristles tufts 22, 23, the tapered bristles 10 of the first bristle tuft 22 have major axes B-B that are non parallel to the major axes B-B of the tapered bristles 10 of the second bristle tuft 23 (see FIGS. 1*b* and 2*b*). The toothbrush 50 comprises a first subset of tapered bristles and a second subset of tapered bristles, wherein the major axes B-B of the first subset of tapered bristles 10 are non-parallel with respect to the major axes B-B of a second subset of tapered bristles 10. In the exemplified embodiment, the first subset of tapered bristles 10 are the tapered bristles 10 within the first bristle tuft 22 and the second subset of tapered bristles 10 are the tapered bristles 10 within the second bristle tuft 23. While in the exemplified embodiment, the first subset of tapered bristles and the second subset of tapered bristles are located entirely within different bristles tufts 22, 23 of the toothbrush 50, in alternate embodiments of the toothbrush 50, the first subset of tapered bristles and the second subset of tapered bristles can be located within the same bristle tuft 20 (such as is shown in FIGS. 8*a-b*). Thus, in such embodiments, the first and second subsets of bristles are not necessarily entire bristle tufts 20, but may include only some of the tapered bristles 10 within a single bristle tuft 20. Alternatively, in certain other embodiments, the first and second subsets of tapered bristles may include tapered bristles from more than a single bristle tuft 20 or it may include some of the tapered bristles within the first bristle tuft 22 and some of the tapered bristles within the second bristle tuft 23.

Figure 7A:
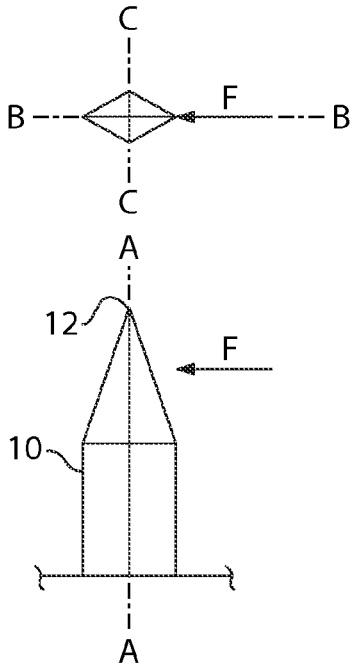
FIG. 7*a* is a first side view of the tapered bristle of FIG. 1*a* in a normal state wherein no force is being applied to the tapered bristle.
Figure 7B:
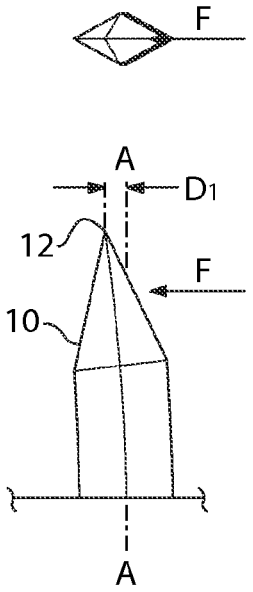
FIG. 7*b* is the tapered bristle of FIG. 7*a* in a deflected state wherein a transverse force is being applied to its free end along the major axis of the transverse cross-sectional profile of the tapered bristle.

Referring now to FIGS. 7*a*-7*d*, the deflection of the tapered bristle 10, when subjected to transverse forces from different directions will be discussed. Referring first to FIGS. 7*a* and 7*b*, the side view of the tapered bristle 10 is illustrated with its major axis B-B extending from left to right on the page. As can be seen, when a transverse force F is applied to the free end 12 of the tapered bristle 10 in a direction parallel to the major axis B-B of the tapered bristle 10, the free end 12 of the bristle 10 deflects a first distance $D_1$ from the longitudinal axis A-A of the tapered bristle 10. Due to the major axis B-B having a greater length (relative to the minor axis C-C), the distance $D_1$ is fairly small.

Figure 7C:
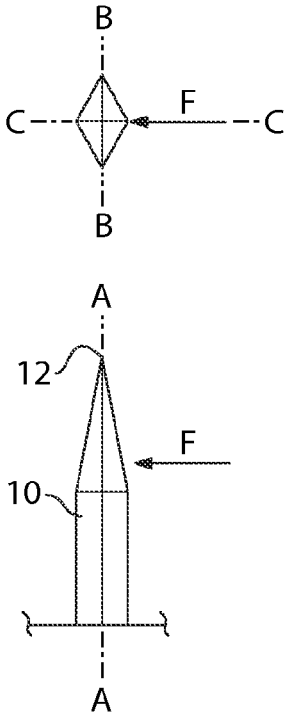
FIG. 7*c* is a second side view of the tapered bristle of FIG. 1*a* in a normal state wherein no force is being applied to the tapered bristle.
Figure 7D:
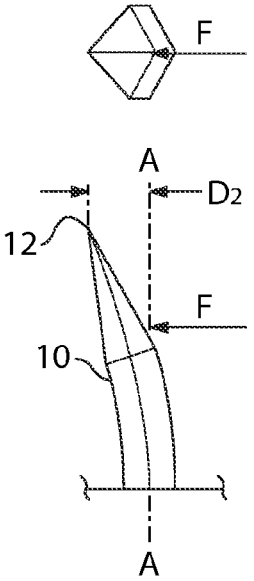
FIG. 7*d* is the tapered bristle of FIG. 7*c* in a deflected state wherein a transverse force is being applied to its free end along the minor axis of the transverse cross-sectional profile of the tapered bristle.

Referring now to FIGS. 7*c* and 7*d*, the side view if the tapered bristle 10 is illustrated with its minor axis C-C extending from left to right on the page. However, when the same transverse force F (same as is applied in FIGS. 7*a-b*) is applied to the free end 12 of the tapered bristle 10 in a direction parallel to the minor axis C-C of the tapered bristle 10, the free end 12 of the bristle 10 deflects a second distance $D_2$ from the longitudinal axis A-A of the tapered bristle 10. Because the minor axis C-C is smaller than the major axis B-B, the second distance $D_2$ is greater than the first distance $D_1$. As a result, the tapered bristle 10 will more greatly resist deflection when the transverse force F applied to the tapered bristle 10 is a direction parallel to the major axis B-B of the tapered bristle 10 than when the same transverse force F is applied to the tapered bristle 10 in a direction parallel to the minor axis C-C of the tapered bristle 10. Thus, the tapered bristle 10 will feel stiffer when moved in certain directions and softer when moved in other directions.

The varying resistance to deflection of the tapered bristle 10 (depending upon the direction of a force acting on the tapered bristle 10) results in the tapered bristle 10 being able to more effectively clean a user's oral cavity than traditional tapered bristles that have transverse axes that are the same (or substantially the same) in length. Specifically, when a user brushes the teeth in a side-to-side manner, the tapered bristle 10 will have a first stiffness and when the user brushes the teeth in an up-and-down manner, the same tapered bristle 10 will have a second different stiffness. Thus, in one brushing direction the tapered bristle 10 can provide a deep scrubbing action and in another brushing direction the tapered bristle 10 can provide a massaging action. The tapered bristle 10 can effectively clean a user's oral cavity while enhancing the comfort during toothbrushing.

Referring now to FIGS. 8*a* and 8*b*, a toothbrush head 60 in accordance with a second embodiment of the present invention will be described. The head 60 is generically illustrated as an elongated oval for ease of discussion. However, the head 60 may take on any configuration or shape as would be known to persons skilled in the art. Furthermore, the head 60 is illustrated having a single tuft hole 61 for convenience and ease of discussion. Of course, the invention is not so limited and the head 60 may have any number of tuft holes in any number of varying configurations as have been described herein and as would be understood by a person skilled in the art.

A bristle tuft 70 is disposed within the tuft hole 61. The bristle tuft 70 comprises a plurality of the bristles 10 described herein above. The bristles 10 in the bristle tuft 70 comprise at least one of a first oriented bristle 71 and at least one of a second oriented bristle 72. The first oriented bristle 71 is positioned in the bristle tuft 70 so that its major axis is non-parallel to the major axis of the second oriented bristle 72. In the embodiment illustrated in FIG. 8*a*, there are eight of the first oriented bristles 71 arranged in two rows of four and three of the second oriented bristles 72 arranged in a single row and disposed between the two rows of the first oriented bristles. In the embodiment illustrated in FIG. 8*b*, there are four of the first oriented bristles 71 arranged in two columns of two and ten of the second oriented bristles 72 arranged in two columns of five. The columns of the first and second oriented bristles 71, 72 are arranged in an alternating configuration. Of course, the number of bristles oriented in a particular fashion and the particular arrangement of the rows and columns is in no way limiting of the present invention.

Furthermore, the first oriented bristles 71 are positioned so that their major axis is parallel to a longitudinal axis of the head 60 and the second oriented bristles 72 are positioned so that their major axis is perpendicular to the longitudinal axis of the head 60. However, the invention is not so limited. The first and second oriented bristles 71, 72 may be positioned in the tuft 70 in any manner so long as the first and second oriented bristles 71, 72 have major axes that are non-parallel with respect to each other. This will enable a user to perceive a different feel during use of a toothbrush having the first and second oriented bristles 71, 72 disposed thereon. This different feel is due to the different stiffness levels based on the orientation of the bristles as described above with reference to FIGS. 7*a*-7*d*.

In certain other embodiments, the first oriented bristles 71 have a transverse cross-sectional profile with a first shape and the second oriented bristles 72 have a transverse cross-sectional profile with a second shape that is different than the first shape. In such an embodiment, the first and second oriented bristles 71, 72 may be oriented so that their major axes are parallel or non-parallel. Thus, for example, the first oriented bristles 71 may have diamond-shaped transverse cross-sectional profiles and the second oriented bristles 72 may have oval or rectangular-shaped transverse cross-sectional profiles. Of course, the particular shapes of the first and second oriented bristles 71, 72 are in no way limiting of the present invention.

Figure 9A:
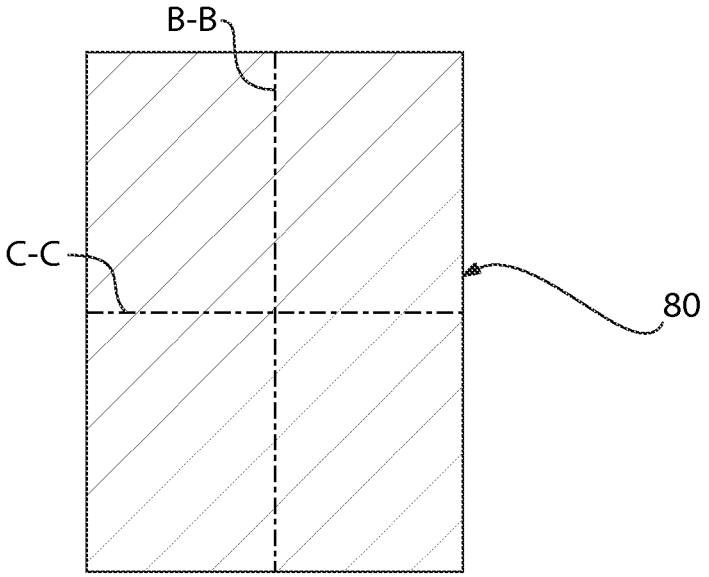
FIG. 9*a* is a transverse cross-sectional profile of a tapered bristle in accordance with an alternative embodiment of the present invention.
Figure 9B:
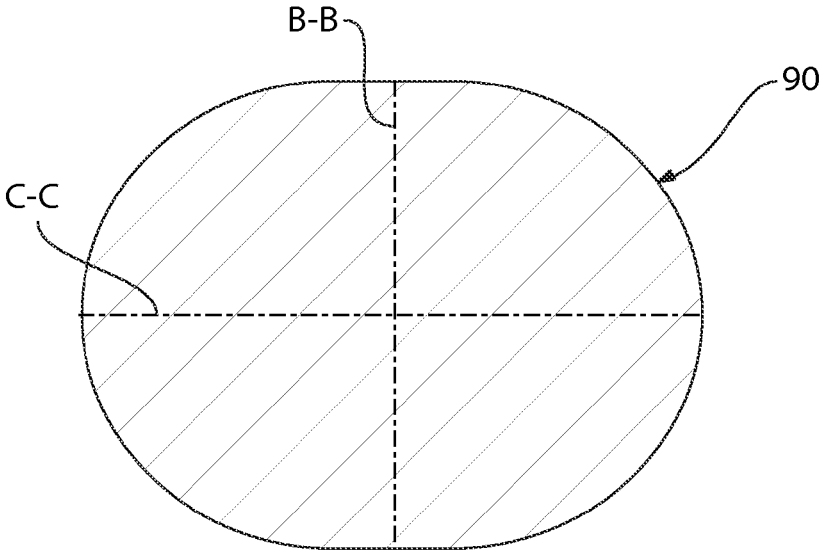
FIG. 9*b* is a transverse cross-sectional profile of a tapered bristle in accordance with an alternative embodiment of the present invention.

Referring to FIGS. 9*a* and 9*b*, alternate shapes for the bristles are illustrated. Specifically, in FIG. 9*a*, a bristle 80 having a rectangular or elongated rectangular transverse cross-sectional profile is illustrated. Furthermore, in FIG. 9*b* a bristle 90 having an ovular or elongated oval transverse cross-sectional profile is illustrated. The bristles 80, 90 still have a major axis and a minor axis such that the major axis is longer than the minor axis. Of course, further alternate shapes of bristles that have a major axis and a minor axis as described above herein can be used as the bristle 10 and incorporated into a toothbrush as described above.

Additionally, in embodiments in which the existence of a major and minor axis is not required in the transverse cross-sectional profile of the bristles, the bristles may take on any other known shapes. For example, the bristles may have transverse cross-sectional profiles that are octagonal, hexagonal, pentagonal, triangular, square or the like. Persons skilled in the art would understand which embodiments do not require the existence of a bristle with a cross-sectional profile having a major and minor axis from the disclosure herein.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the foregoing description and drawings represent the exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. An oral care implement comprising:

a head having a face with a tuft hole therein;

a handle coupled to the head;

a plurality of tapered bristles disposed within the tuft hole and arranged in a bristle tuft that extends from the face of the head, the bristle tuft comprising a first subset of the tapered bristles and a second subset of the tapered bristles;

wherein each of the tapered bristles comprises a longitudinal axis and a transverse cross-sectional profile having a major axis and a minor axis, the major axes of the tapered bristles being longer than the minor axes of the tapered bristles;

wherein the major axes of the tapered bristles of the first subset are non-parallel to the major axes of the tapered bristles of the second subset; and wherein the first and second subsets of the tapered bristles are arranged in an alternating configuration of columns or rows.

2. The oral care implement of claim 1 wherein the transverse cross-sectional profile of each of the tapered bristles is a diamond.

3. The oral care implement of claim 1 wherein for each of the tapered bristles a ratio of the major axis to the minor axis is greater than or equal to 1.2:1.

4. The oral care implement of claim 1 wherein for each of the tapered bristles a ratio of the major axis to the minor axis is between 1.5:1 to 3:1.

5. The oral care implement of claim 1 wherein a free end of each of the tapered bristles deflects a first distance from the longitudinal axis when a transverse force is applied to the free end of the tapered bristle in a direction parallel to the minor axis, and wherein the free end of each of the tapered bristles deflects a second distance from the longitudinal axis when the transverse force is applied to the free end of the tapered bristle in a direction parallel to the major axis, the second distance being less than the first distance.

6. The oral care implement of claim 1 wherein each of the tapered bristles comprises a tapered longitudinal section and a non-tapered longitudinal section.

7. The oral care implement of claim 6 wherein the non-tapered longitudinal section of each of the tapered bristles extends from the face of the head to a transition point of the tapered bristle and the tapered longitudinal section of each of the tapered bristles extends from the transition point to a free end of the tapered bristle, the tapered longitudinal section of each of the tapered bristles extending at least one-third of the length of the tapered bristle, the length of each of the tapered bristles measured from the face of the head to the free end of the tapered bristle along the longitudinal axis of the tapered bristle.

8. The oral care implement of claim 7 wherein the tapered longitudinal section of each of the tapered bristles extends at least one-half the length of the tapered bristle.

9. The oral care implement of claim 1 wherein the tapered bristles of the first subset are aligned along a first axis and wherein the tapered bristles of the second subset are aligned along a second axis that is parallel to and spaced apart from the first axis, and wherein the major axes of the tapered bristles of the first subset are perpendicular to the major axes of the tapered bristles of the second subset.

10. The oral care implement of claim 1 wherein the transverse cross-sectional profile of the tapered bristles of the first subset of the tapered bristles has a first shape, and wherein the transverse cross-sectional profile of the tapered bristles of the second subset of the tapered bristles has a second shape that is different than the first shape.

11. The oral care implement of claim 1 wherein the tuft hole has a non-oval transverse cross-sectional profile.

12. The oral care implement of claim 1 wherein the head further comprises a tuft plate, the tuft hole extending from an upper surface of the tuft plate to a lower surface of the tuft plate, the bristle tuft mounted to the tuft plate by a melted portion of the bristle tuft protruding from the lower surface of the tuft plate, the bristle tuft extending from the upper surface of the tuft plate, and the tuft plate mounted to a body of the head.

13. The oral care implement of claim 1 wherein the tapered bristles of the first subset have major axes that extend substantially parallel to a longitudinal axis of the head and the tapered bristles of the second subset have major axes that extend substantially perpendicular to the longitudinal axis of the head.

14. The oral care implement of claim 1 wherein each of the tapered bristles is formed of polybutylene terephthalate, polyethylene terephthalate, or nylon.

15. The oral care implement of claim 1 wherein for each of the tapered bristles, the major axis is substantially perpendicular to the minor axis.

16. The oral care implement of claim 15 wherein for each of the tapered bristles, the major axis and the minor axis intersect at a center point of the transverse cross-sectional profile.

17. The oral care implement of claim 16 wherein for each of the tapered bristles, the major axis extends between a first pair of opposing apexes of the transverse cross-sectional profile and the minor axis extends between a second pair of opposing apexes of the transverse cross-sectional profile.

18. The oral care implement of claim 1 wherein the major axes of each of the tapered bristles of the first subset are parallel to one another and wherein the major axes of each of the tapered bristles of the second subset are parallel to one another.

19. The oral care implement of claim 18 wherein the major axes of each of the tapered bristles of the first subset are perpendicular to the major axes of each of the tapered bristles of the second subset.

20. An oral care implement comprising:

a head having a face with at least one tuft hole therein;

a handle coupled to the head;

a plurality of tapered bristles disposed within the tuft hole and arranged in a bristle tuft that extends from the face of the head, each of the tapered bristles having a longitudinal axis and a transverse cross-sectional profile having a major axis and a minor axis, the major axis being longer than the minor axis;

wherein the plurality of tapered bristles of the bristle tuft comprises a first one of the tapered bristles and a second one of the tapered bristles, wherein the major axis of the first one of the tapered bristles is non-parallel to the major axis of the second one of the tapered bristles; and wherein the transverse cross-sectional profile of the first and second ones of the tapered bristles is a diamond.

* * * * *